US009333509B2

(12) United States Patent
Cochran

(10) Patent No.: US 9,333,509 B2
(45) Date of Patent: May 10, 2016

(54) GRAPPLE GRINDER

(71) Applicant: Coneqtec. Corp., Wichita, KS (US)

(72) Inventor: Gary L. Cochran, Colwich, KS (US)

(73) Assignee: Coneqtec Corp., Wichita, KS (US)

( * ) Notice: Subject to any disclaimer, the term of this patent is extended or adjusted under 35 U.S.C. 154(b) by 412 days.

(21) Appl. No.: 13/867,393

(22) Filed: Apr. 22, 2013

(65) Prior Publication Data

US 2013/0284837 A1 Oct. 31, 2013

Related U.S. Application Data

(60) Provisional application No. 61/638,524, filed on Apr. 26, 2012.

(51) Int. Cl.
*B02C 21/02* (2006.01)
*B02C 18/22* (2006.01)

(52) U.S. Cl.
CPC ..... *B02C 18/2275* (2013.01); *B02C 21/026* (2013.01); *B02C 2021/023* (2013.01)

(58) Field of Classification Search
CPC ..... B02C 18/2275; B02C 21/026; B02C 2021/023; B02C 21/02
USPC ..... 241/101.72, 101.73, 101.742, 101.763, 241/101.77
See application file for complete search history.

(56) References Cited

U.S. PATENT DOCUMENTS

| | | | | |
|---|---|---|---|---|
| 2,537,404 | A | 1/1951 | Garretson | |
| 2,836,023 | A | 5/1958 | Caldwell | |
| 4,232,719 | A | 11/1980 | Payton | |
| 4,236,554 | A * | 12/1980 | Nicholson | A01G 23/08 144/174 |
| 4,355,670 | A | 10/1982 | Ohrberg et al. | |
| 4,412,660 | A | 11/1983 | Morin | |
| 4,550,554 | A | 11/1985 | Lundahl et al. | |
| 4,690,224 | A | 9/1987 | Shwez | |
| 4,767,067 | A | 8/1988 | Bruer et al. | |
| 4,934,612 | A | 6/1990 | Johnson | |
| 6,659,378 | B2 | 12/2003 | Di Anna | |
| 7,096,900 | B2 | 8/2006 | Schafer | |
| 8,117,771 | B2 | 2/2012 | Risi | |
| 2002/0124442 | A1 * | 9/2002 | Waddington, Jr. | E02F 3/404 37/406 |
| 2007/0107270 | A1 * | 5/2007 | Edmond | E02F 3/142 37/403 |

* cited by examiner

*Primary Examiner* — Mark Rosenbaum
(74) *Attorney, Agent, or Firm* — Woodard, Emhardt, Moriarty, McNett & Henry LLP

(57) ABSTRACT

A portable grinder unit includes a plurality of grinder heads for rending waste debris. A pair of side grapple arms are independently movable between a receive position and a feed position. A top grapple arm is movable between a receive position and a feed position. The grinder unit is mountable to a support vehicle and can receive mechanical power from the support vehicle.

19 Claims, 11 Drawing Sheets

GRAPPLE GRINDER

CROSS-REFERENCE TO RELATED APPLICATION

This application claims the benefit of U.S. Provisional Application No. 61/638,524 filed Apr. 26, 2012, which is hereby incorporated by reference.

BACKGROUND

The present disclosure relates to a hydraulic or other power driven device for use in cleanup of debris after natural disasters, demolition or construction site cleanup as well as other applications. The device described herein is a system that is added to prime movers such as skid-steer loaders and other construction equipment, but is believed to be useful in other applications as well.

Debris fields are created from natural disasters (e.g. tornadoes, hurricanes, ice storms, and floods, etc.) as well as through man-made projects such as demolition. A major problem involves removing grindable debris before reconstruction can occur. Traditionally, natural or man-made debris is gathered by loaders of various types and placed into trucks to be taken to remote areas where the debris will be processed. In some cases, columns of dump trucks transport debris between the debris fields and a dumpsite. At the dumpsite, the debris is either burned or reduced to debris which is easier to handle. Alternatively, the debris can be placed directly into a landfill. When trucks are used to remove debris from the debris site in its natural state, the trucks are often only minimally loaded from a weight perspective due to the intrinsically low density and high volume of tangled masses of trees, other natural debris, and sometimes man-made debris. This limits the speed of the debris removal as the trucks are not loaded to their weight capacity. Accordingly, the efficiency of the removal process is greatly reduced.

In some cases, stationary chippers or grinders can be located at the debris field and used to reduce the volume of the debris by rending it into smaller chunks or chips so that trucks can haul off a more compact product. However, these are expensive and inefficient to operate. Chippers and grinders are capable of being loaded by only one vehicle at a time. Additionally, chippers and grinders are capable of loading reduced or treated debris into one truck at a time. The debris must be moved twice. The debris must first be transported through the debris field to the chipper or grinder. The debris must then be loaded onto a truck and transported from the debris field to the dumpsite. These procedural steps slow the process of removing debris from the debris field greatly by requiring set up and additional transport time.

Thus, there is a need for a system that is capable of speeding up the debris clearing process as well as providing high density shredded debris in order to increase efficiency and to save fuel, time, and other costs of the cleanup operation.

SUMMARY

A grinder unit, such as the examples described herein, addresses the issues mentioned above as well as others. This is achieved by a portable grinder unit which can readily be moved about a debris site to comminute debris on location, leaving shredded debris which is ready to be loaded onto trucks for transport. The portable grinder unit allows an increase in the efficiency and utilization of transport trucks by facilitating filling of the trucks to their maximum weight capacity without the need for stationary grinders or chippers.

In one example, a device includes a grinder unit with a frame defining a vertical facing feed opening for receiving debris to be comminuted. The feed opening has a top edge and two lateral sides. A top grapple arm can be pivotally mounted to the frame adjacent to the top edge of the feed opening. At least one side grapple arm can be movably mounted to the frame adjacent to a side of the feed opening so that the side grapple arm is pivotable between a receive position and a feed position. The side grapple arm can advance debris toward the feed opening when moving from the receive position to the feed position. The pivot axes of the top grapple arm and the side grapple arm can be non-parallel.

The device can include a pair of side grapple arms pivotally mounted to the frame adjacent to opposite sides of the feed opening so that the side grapple arms are each pivotable between a receive position and a feed position. The side grapple arms can advance debris towards the feed opening when moving from the receive position to the feed position. The pair of side grapple arms can be pivotable relative to each other. The side grapple arms can be movable within a height between the top grapple arm and the bottom member.

Each side grapple arm can include a coupler for pushing debris so that when in the feed position, the couplers are aligned with and adjacent to the feed opening. Each side grapple arm can include a four-bar mechanism having a rocker and/or crank so that when moving between the receive position and the feed position, the coupler rotates less than the rocker and/or crank relative to the grinder unit. Each four-bar mechanism can include a plurality of couplers and a plurality of rockers and/or cranks so that the rockers are interleaved with the couplers.

The grinder unit can include a bottom member extending forward from the frame. The bottom member can have an inclined surface for moving debris vertically towards the feed opening. The top grapple arm can rotate about an axis that is nonparallel to the axes of the side grapple arms. The device can include a discharge opening defined by the frame and positioned below the grinder unit for passage of comminuted debris. The grinder unit can be attached to a skid-steer loader including a hydraulic system for providing mechanical power to the side grapple arm and top grapple arm.

In one example, a device includes a grinder unit with a frame defining a vertical facing feed opening for receiving debris to be comminuted. The feed opening has a top edge, two lateral sides, and a bottom portion. A bottom member can be attached to the grinder unit to wedge beneath debris when the grinder unit is advanced toward debris. A pivotable top grapple arm can be attached adjacent to the top edge of the feed opening to compress debris and reduce the height of the debris. A pair of movable side grapple arms can be attached adjacent to the sides of the feed opening to move debris between the bottom member and the top grapple arm and towards the feed opening.

Further forms, objects, features, aspects, benefits, advantages, and examples of the present disclosure will become apparent from a detailed description and drawings provided herewith.

DESCRIPTION OF THE SELECTED EXAMPLES

Figure 1:
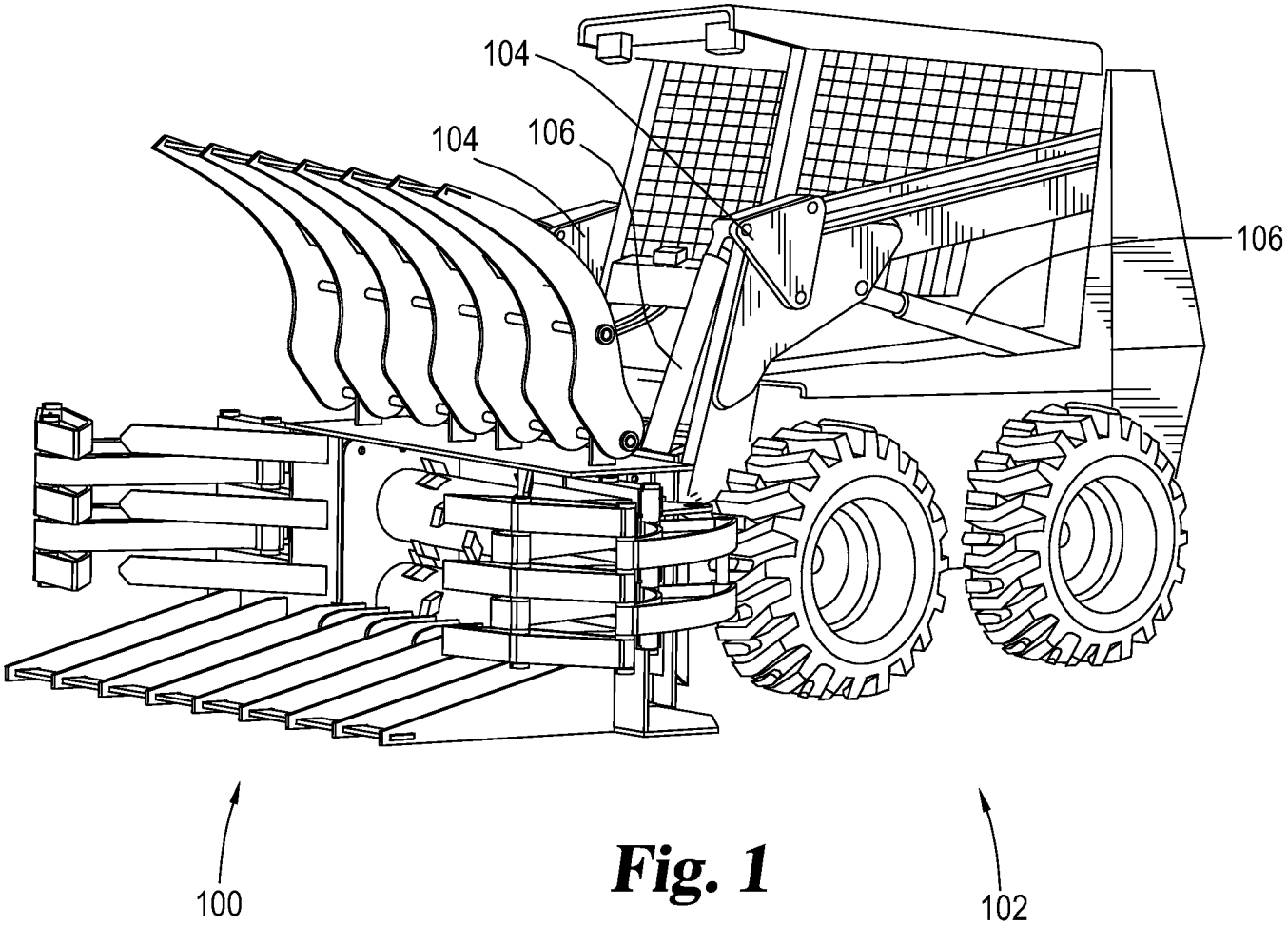
FIG. 1 is a front perspective view of a grinder system including a grinder unit attached to a skid-steer loader.

For the purpose of promoting an understanding of the principles of the disclosure, reference will now be made to the examples illustrated in the drawings and specific language will be used to describe the same. It will nevertheless be understood that no limitation of the scope of the disclosure is thereby intended. Any alterations and further modifications in the described examples, and any further applications of the principles of the disclosure as described herein are contemplated as would normally occur to one skilled in the art to which the disclosure relates. One example of the disclosure is shown in detail, although it will be apparent to those skilled in the relevant art that some features which are not relevant to the present disclosure may not be shown for the sake of clarity.

Referring generally to FIG. 1, a grinder system includes a grinder unit 100 which is attached to a support vehicle, one example of which is a skid-steer loader 102. A typical skid-steer loader 102 is a type of support vehicle having a frame, four wheels or tracks, an operator position such as a cage or cab with a seat, and a pair of left and right front lift arms 104. The skid-steer loader 102 includes one or more hydraulic cylinders 106 which are part of a hydraulic power system. Various powered work tool implements can be interchangeably mounted to the skid-steer loader, for example by being coupled and uncoupled from the lift arms 104. The hydraulic system can be selectively coupled directly or through an interface to certain work implements (for example, the grinder unit 100) to provide hydraulic power to the implements. Generally the skid-steer loader and any work implements can be controlled by an operator through a control accessible by the operator.

Figure 2:
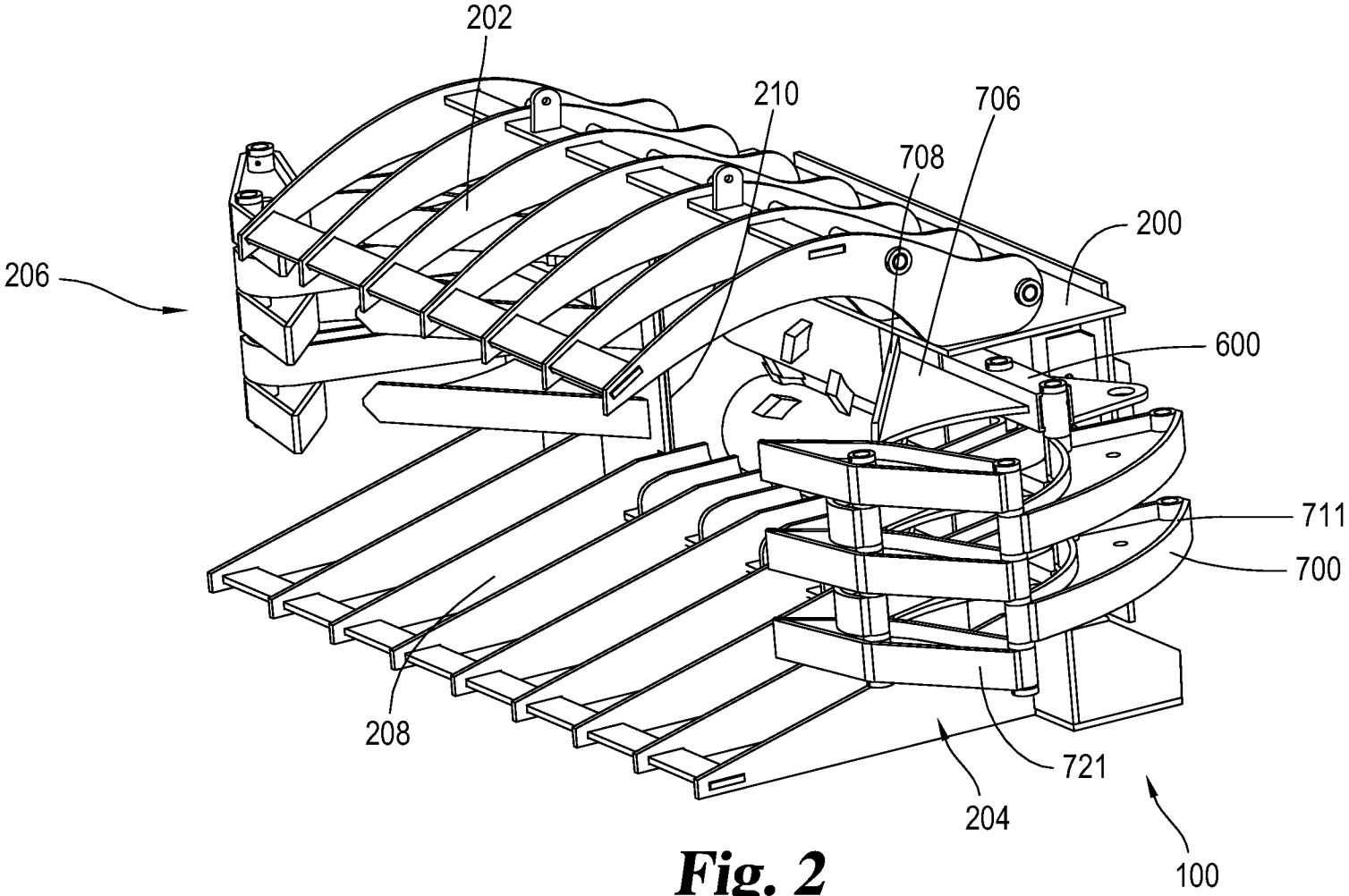
FIG. 2 is a perspective view of the grinder unit of FIG. 1.
Figure 3:
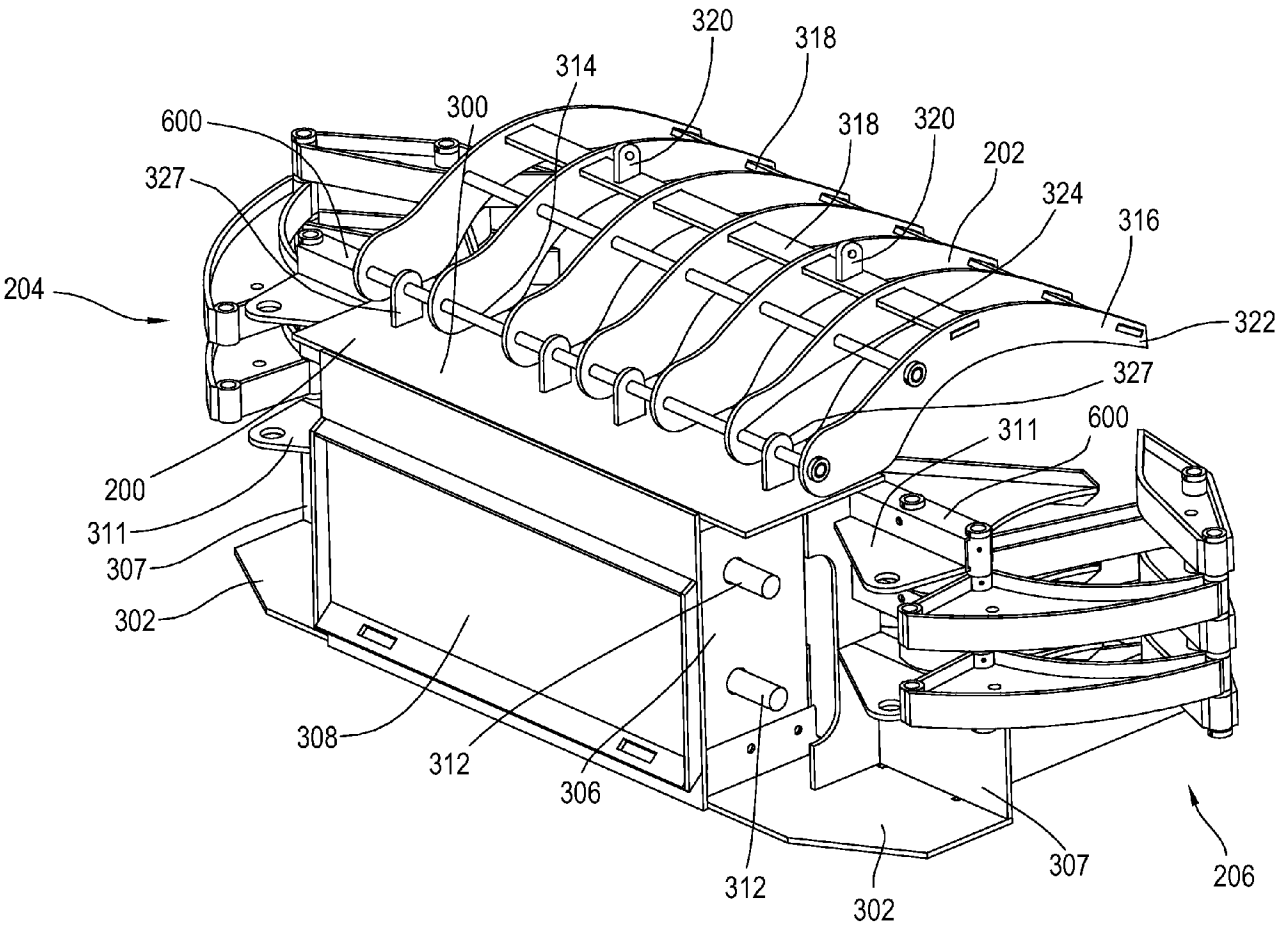
FIG. 3 is a rear perspective view of the grinder unit of FIG. 1.
Figure 4:
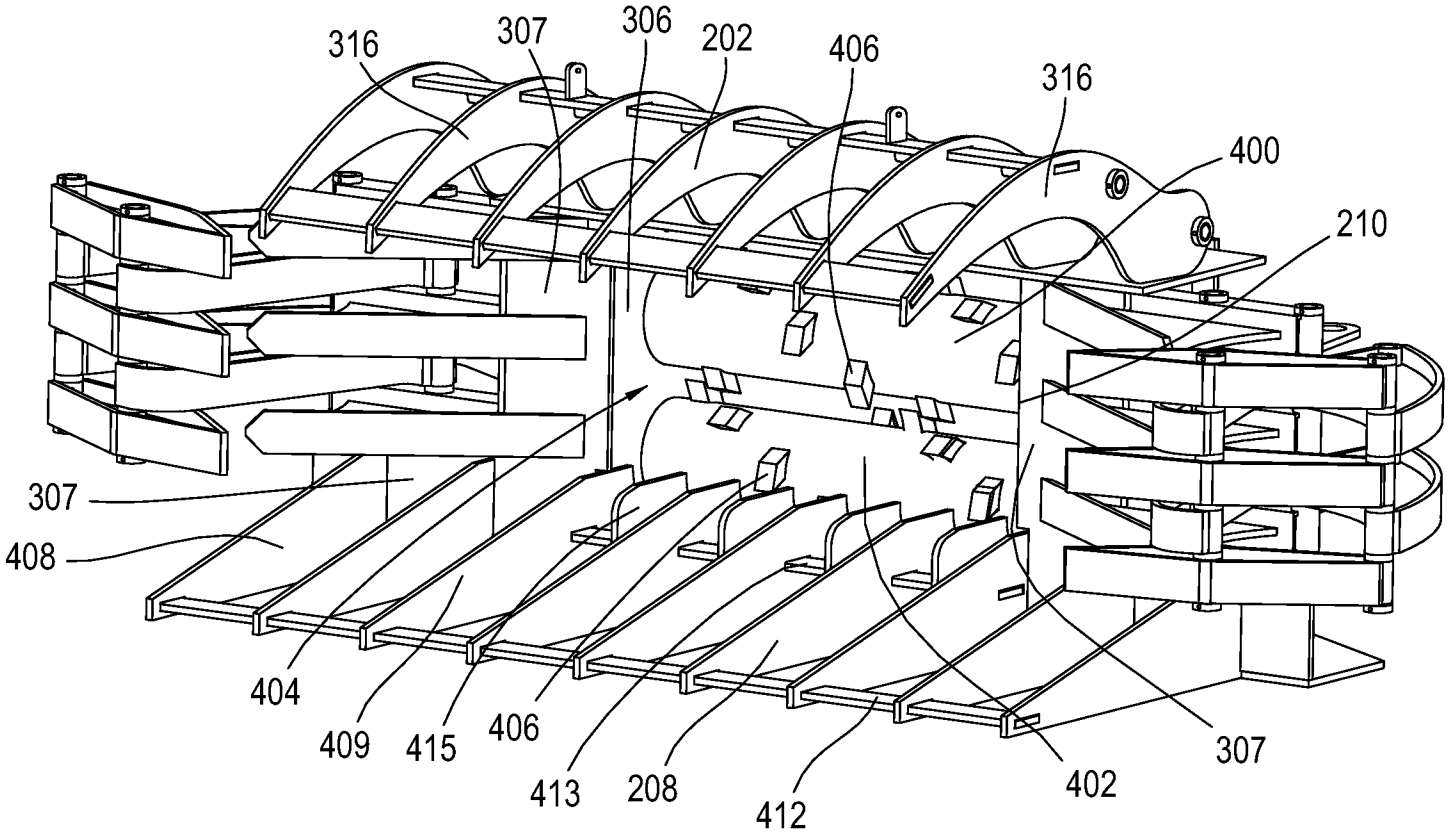
FIG. 4 is a front perspective view of the grinder unit of FIG. 1.
Figure 5:
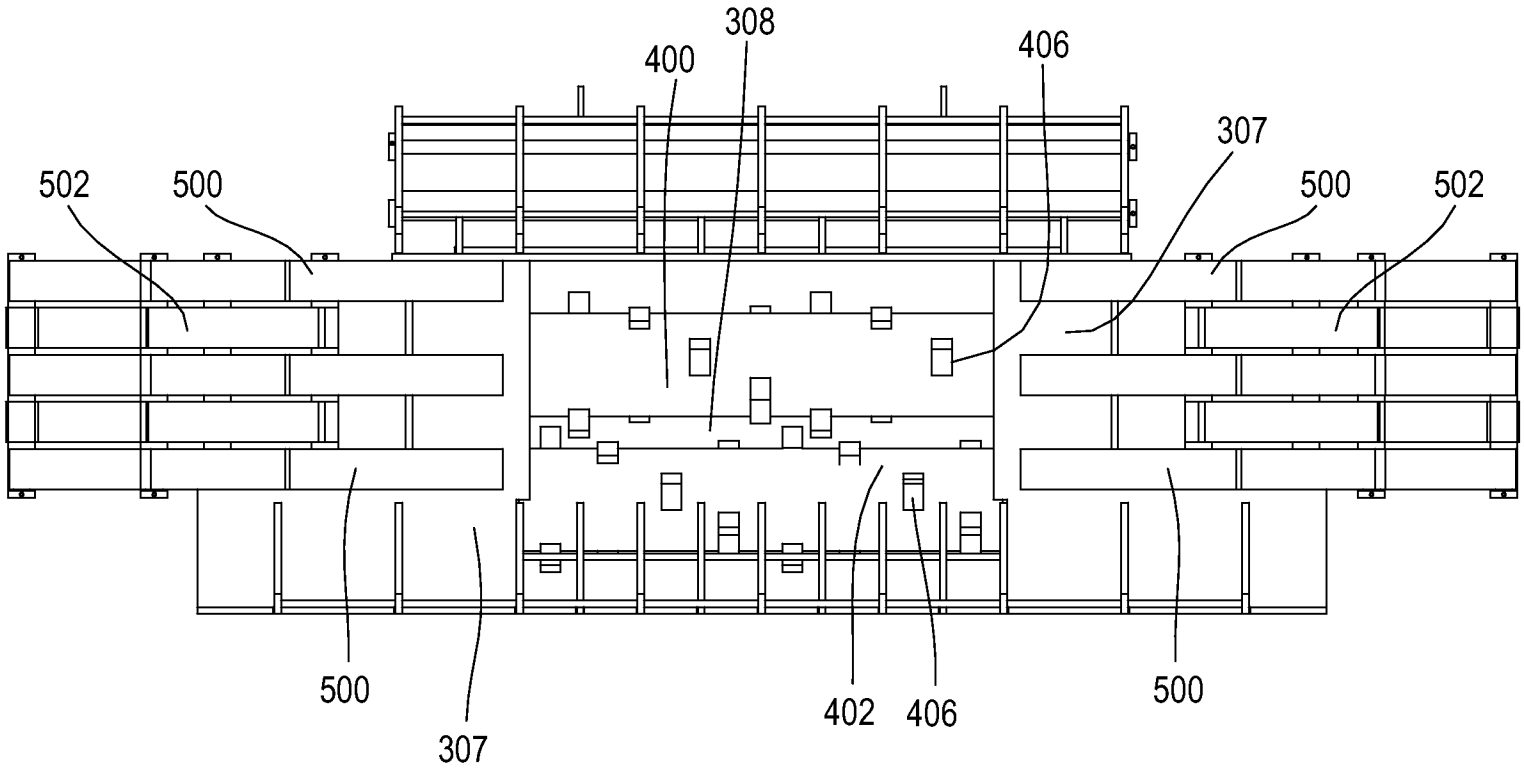
FIG. 5 is a front view of the grinder unit of FIG. 1.
Figure 6:
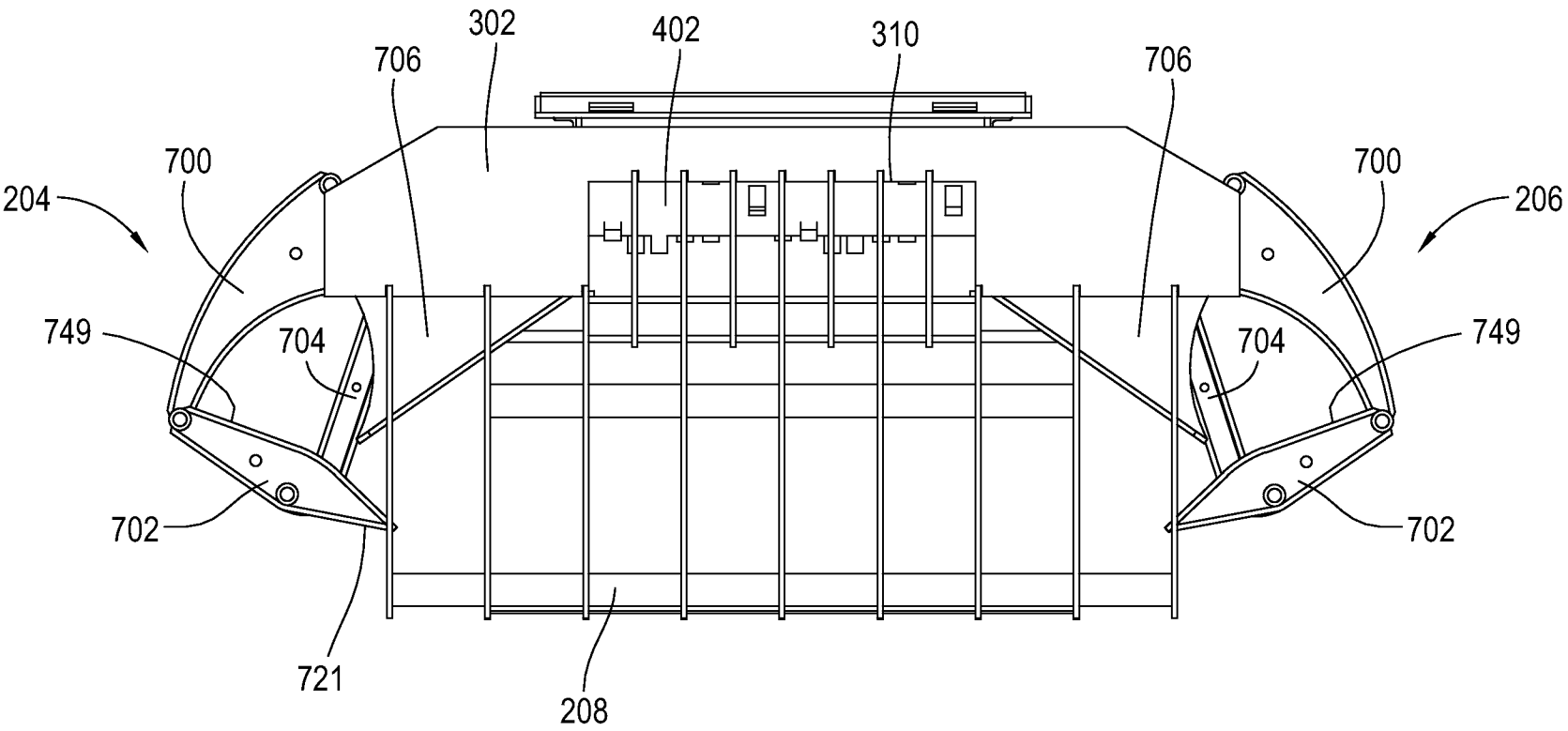
FIG. 6 is a bottom view of the grinder unit of FIG. 1.

Referring generally to FIGS. 2-11, the grinder unit 100 includes a frame 200, a top grapple arm 202, side grapple arms 204, 206 (i.e. a left grapple arm 204 and a right grapple arm 206), a bottom member 208, and a vertical facing feed opening 210. Positioned within the frame 200 is a top grinder head 400 and a bottom grinder head 402 (FIG. 4). The grinder heads 400, 402 may receive debris, comminute or rend the debris into smaller, shredded pieces, and pass the shredded debris through the grinder unit 100. Generally, during use, the grinder unit 100 is moved through a debris field toward debris. The grinder unit 100 may receive debris fed into the grinder head over the bottom member 208. The top grapple arm 202 may pivot and push debris downward and the side grapple arms 204, 206 may pivot and push debris inward from the sides as well as towards the feed opening 210.

As illustrated, the frame 200 includes a top plate 300 (FIGS. 3 and 7), a bottom plate 302 (FIGS. 3 and 6), sidewalls 306 (FIGS. 3 and 8), front plates 307 (FIG. 5), and a back plate or debris shield 308 (FIG. 3). The sidewalls 306 span the distance between the top plate 300 and the bottom plate 302. Similarly, the front plates 307 and the debris shield 308 span the distance between the top plate 300 and the bottom plate 302. The feed opening 210 has a width defined by the distance between the front plates 307 and a height defined by the distance between the top plate 300 and the bottom plate 302. The top plate 300 defines a top edge of the feed opening 210. On either side of the feed opening 210, the intersection between the side walls 306 and the front plates 307 defines lateral sides of the feed opening 210. A bottom portion of the feed opening 210 is adjacent to and partially defined by the bottom member 208 and is positioned opposite from the top edge. The top plate 300, bottom plate 302, sidewalls 306, and debris shield 308 form a grinding cavity 404 (FIG. 4). The grinder heads 400, 402 are rotatably mounted to the frame 200 within the grinding cavity 404 and adjacent to the feed opening 210.

The front plates 307 include a bottom portion for mounting a part of the bottom member 208 as well as a top portion for mounting a part of the side grapple arms 204, 206 (e.g. FIG. 4). The bottom plate 302 includes a discharge opening 310. The discharge opening 310 is an opening or space defined by the bottom plate 302. The debris shield 308 provides a barrier between shredded debris and the support vehicle as well as providing a guiding surface to allow shredded debris to pass through the discharge opening 310. In some examples, the frame 200 can include mounts 311 (FIG. 3) positioned at either side of the grinder unit 100. The frame 200 is generally configured to be mounted to the lift arms 104 of the skid-steer loader 102 or other support vehicle via mounts 311. In other examples, mounts can be positioned at other locations of the frame for attachment to a skid-steer loader 102 or other vehicles.

The use of side grapple arms provides a grinder unit that is not only portable, but also provides effective and efficient rending of debris. The side grapple arms 204, 206 are attached to the frame 200 adjacent to the lateral sides of the feed opening 210 and allow the grinder unit 100 to move debris towards the feed opening 210. Referring generally to FIGS. 2-11, the side grapple arms 204, 206 are each configured as four-bar linkage mechanisms having vertically stacked and spaced grapple arm linkage elements which share common pivot axes. The four-bar linkage provides the side grapple arms 204, 206 with a motion that is advantageous for moving debris from the bottom member 208 through the feed opening 210. The linkage elements of the side grapple arms 204, 206 may include pluralities of fixed links 600, cranks 700, couplers 702, and rockers 704 (e.g. FIGS. 2, 3, and 7). The grapple arm linkage elements may be configured in a stacked arrangement having three each of the fixed links 600 and the couplers 702, and two each of the cranks 700 and the rockers 704. The cranks 700 and rockers 704 can be interleaved vertically between the fixed links 600 and the couplers 702. In the illustrated example, the grinder unit 100 includes two side grapple arms 204, 206. For clarity, in portions of the following description, parts of a single side grapple arm are described. However, it should be understood that the description applies to both side grapple arms 204, 206.

A plurality of pivot joints 800 rotatably connect the linkage elements of the grapple arms 204, 206, and generally share a common structure. Pivot joints 800 having similar function and positioned at different axes in the grapple arms 204, 206 are referred to herein as pivot joints 800, 800', 800", and 800'". The pivot joints 800 may be any of a variety of pivotal coupling means which are known in the art. In the illustrated example, the pivot joints 800 include a bushing (i.e. hollow cylindrical portion) which is integrated with or attached to a linkage element (e.g. the fixed links 600). The cylindrical portion is oriented with an axis extending vertically. The cylindrical portion is configured to accept an axle, pivot pin, or other suitable structure. Bearings, lubricants, or other devices may be used to rotatably couple the shaft with the cylindrical portions. In some examples, multiple linkage elements are interleaved in which case the multiple linkage elements are all rotatable about a single axis via a pivot joint 800.

The fixed links 600 (or ground links) are support beams which are attached at one end to the frame 200, and are thus fixed relative to the frame 200. The fixed links 600 provide support for the moving parts of the side grapple arms 204, 206. In the illustrated example, the fixed links 600 are beams in the form of hollow structural sections having a substantially rectangular profile, although, other types of beams or supports could be used. In the illustrated example, the side grapple arms 204, 206 include three fixed links 600 (FIG. 8). Other examples can include more or less fixed links 600. At the end of the fixed links 600 that are opposite to the frame 200 are pivot joints 800 positioned at axis 850. An additional pivot joint 800' is positioned at axis 853 between the frame 200 and the pivot joint 800 (e.g. FIG. 7). The pivot joints 800 rotatably connect the fixed links 600 to the cranks 700, and the pivot joints 800' rotatably connect the fixed links 600 to the rockers 704, as described below.

A plurality of biasing plates 706 can be attached to the fixed links 600 and to the frame 200. The biasing plates 706 are formed as three sided objects with one side attached to a side surface of the fixed links 600 and also to the front plate 307. The biasing plates 706 may include flanges 708 attached to one side of the biasing plates 706. The flanges 708 extend at an angle outward from the feed opening 210. The flanges 708 have a biasing surface 500 which tends to guide debris inward towards the grinder heads 400, 402 when the side grapple arms 204, 206 push debris towards the feed opening.

Figure 7:
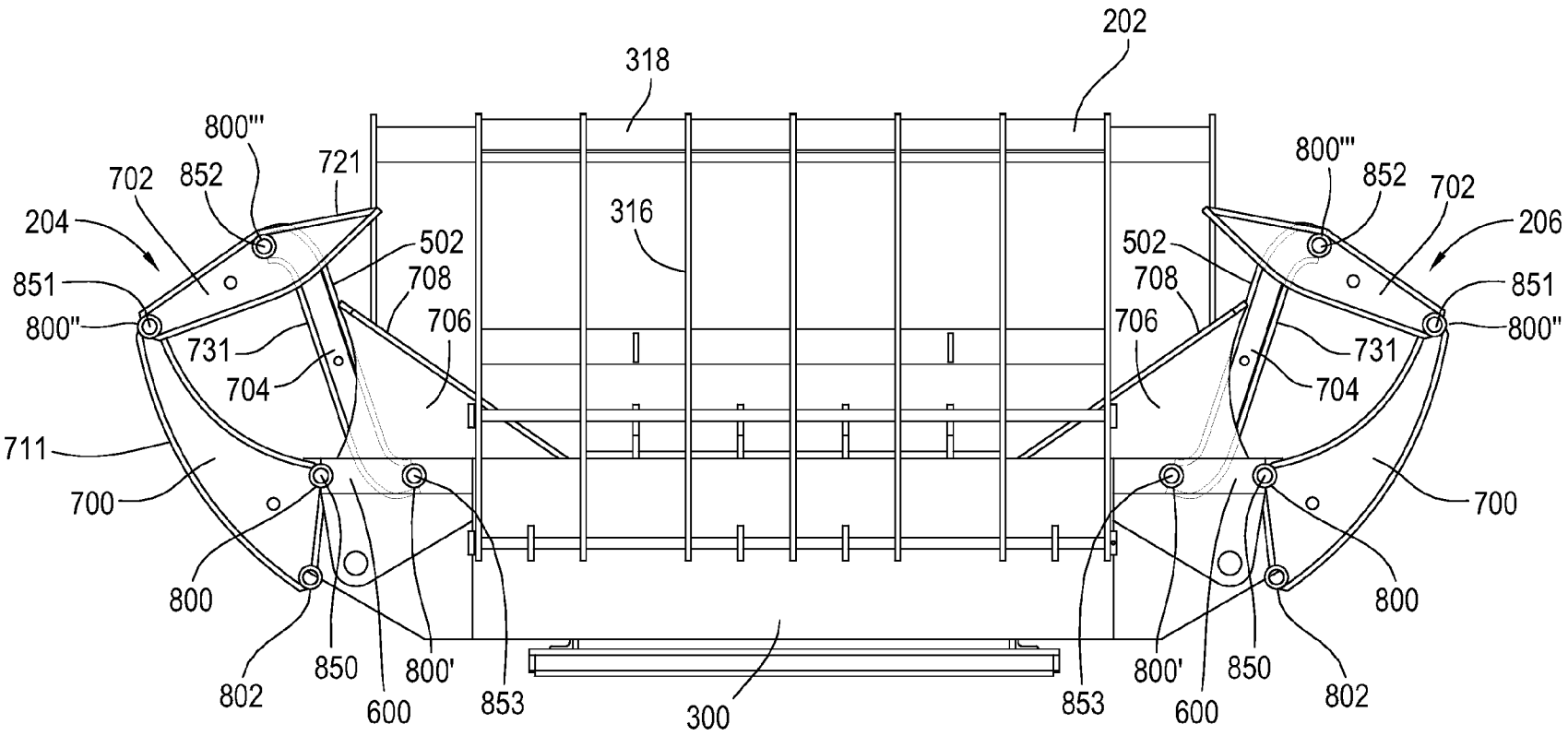
FIG. 7 is a top view of the grinder unit of FIG. 1.
Figure 8:
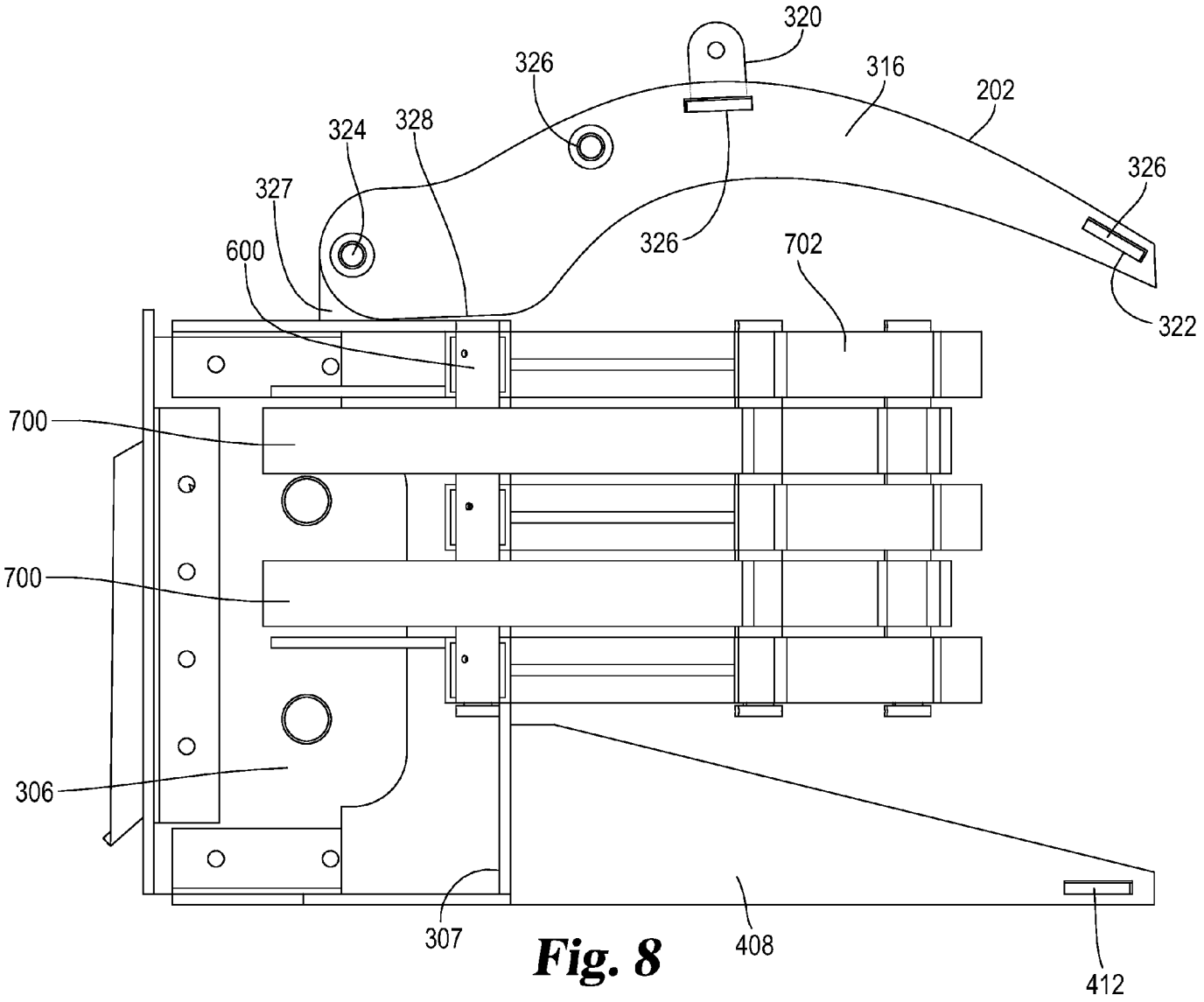
FIG. 8 is a side view of the grinder unit of FIG. 1.

The cranks 700 are formed as a three sided structural element having a flange 711 extending along each side (e.g. FIGS. 2 and 7). The structure is similar to a modified I-beam configuration which provides a structurally rigid frame while minimizing the mass of the cranks 700. The cranks 700 may be vertically offset and interleaved with the fixed links 600. Each side grapple arm 204, 206 includes two cranks 700, although in other configurations more or less cranks 700 are included. The cranks 700 have pivot joints 800 which couple with the pivot joints 800 of the fixed links 600 at axis 850. The cranks 700 also have a pivot joint 800" positioned at one end of the cranks 700 that rotatably connects the cranks 700 to the couplers 702 at axis 851.

The couplers 702 are formed as an elongated quadrilateral having four sides. The couplers 702 are formed in a modified I-beam configuration (similar to the cranks 700) and may have a flange 721 extending along the sides (e.g. FIG. 7). The couplers 702 are vertically offset from and interleaved with the cranks 700. Each side grapple arm 204, 206 includes three couplers 702, although in other configurations more or less couplers 702 are be included. The couplers 702 may include a pivot joint 800" at axis 851 and positioned at an end of the couplers 702. The end opposite of the pivot joint 800 at axes 851 has sides which form an acute angle. A pivot joint 800'" is positioned between the two ends of the couplers 702 at axis 852. The pivot joint 800" is aligned with axis 851 and couples with the pivot joint 800" of the cranks 700. The pivot joint 800'" at axis 852 provides a rotatable connection to the rockers 704.

The rockers 704 are formed generally in an elongated "S" shape. The rockers 704 are also formed in a modified I-beam configuration and have a flange 731 extending along the sides (e.g. FIG. 7). Each side grapple arm 204, 206 includes two rockers 704, although in other configurations more or less rockers 704 may be included. The rockers 704 are vertically offset and interleaved with the couplers 702. The rockers 704 include a pivot joint 800'" positioned at one extent of the "S" shape. The pivot joint 800'" provides a rotatable connection between the rockers 704 and the couplers 702 at axis 852. The rockers 704 also include a pivot joint 800' positioned at the other extent of the "S" shape. The pivot joints 800' provide a rotatable connection between the rockers 704 and the fixed links 600 at axis 853.

The side grapple arms 204, 206 may be movable between a receive position (e.g. FIGS. 1 and 7) for receiving debris to be comminuted, and a feed position (e.g. FIG. 10) for feeding debris into the grinder unit 100. The four-bar mechanism configuration of the side grapple arms 204, 206 allows the couplers 702 to maintain an advantageous angle with respect to the feed opening 210, so that substantially all of the debris is forced into the feed opening 210. When in the feed position, the side grapple arms 204, 206 are more proximate to the grinder heads 400, 402 relative to the receive position. In particular, in the feed position, the couplers 702 from each grapple arm are adjacent to one another and substantially span the feed opening 210.

The cranks 700 include driver pivot joints 802 (FIG. 7) which are configured to receive mechanical power for operation of the side grapple arms 204, 206. To engage the side grapple arms 204, 206, a hydraulic actuator (or other mechanical power source) can act upon the cranks 700 at the driver pivot joints 802. This causes the cranks 700 to rotate about axes 850. Simultaneously, the couplers 702 move about axis 850 in response to the rotation of the cranks 700. The rockers 704 rotate about axis 853 in response to the movement of the couplers 702. The rockers 704 constrain the couplers 702 at axis 852 while the cranks 700 constrain the couplers 702 at axis 851 which allows the couplers 702 to move through a defined path between the receive position and the feed position. The flanges 708 of the couplers 702 have surfaces 749 (FIG. 6) which can abut against debris and urge it to move towards the feed opening 210. Similarly, the biasing surfaces 500 of the biasing plates 706 can also abut against debris and bias it towards the feed opening 210.

The path of the couplers 702 can be designed to pass relatively close to the outermost extent of the biasing surfaces 500 so that debris is sufficiently contained within the grasp of the grinder unit 100. When moving from the receive position to the feed position, as the couplers 702 begin to move past the biasing surfaces 500, the flanges 731 of the rockers 704 have surfaces 502 (FIG. 7) which also abut against the debris and urge a portion of the debris to move towards the feed opening 210. The interleaved configuration of the biasing plates 706 and the rockers 704 reduces gaps or spaces in the side grapple arms 204, 206 which minimizes or eliminates debris which would otherwise escape the grasp of the grinder unit 100. In that way, the four-bar linkage configuration of the side grapple arms 204, 206 can facilitate a path of motion of the couplers 702 that is advantageous for collecting and rending debris.

In other examples (not shown), the side grapple arms can be a single element that is pivotable about an axis. The left grapple arm 204 may be movable independent of the right grapple arm 206. For example, the left grapple arm 204 can be positioned in the side arm feed position while the right grapple arm 206 is positioned in the side arm receive position. Similarly, at any moment each grapple arm may be independently positionable between the side arm receive position and the side arm feed position.

The grinder unit 100 includes the top grapple arm 202 which can be used to smash debris or otherwise reduce the height of debris loaded onto the bottom member 208 so that it can enter the feed opening 210. The top grapple arm 202 is attached to the top plate 300 adjacent to the top edge of the feed opening 210. The top grapple arm 202 may include multiple ribs 316 (i.e. vertically-oriented plates) and supports 318 (FIG. 3). The ribs 316 are vertically oriented and shaped with a curvature (e.g. FIG. 8) that terminates at an end 322. The opposite end includes a rotation coupling hole 324. The ribs 316 also include support coupling holes 326 which are configured to receive the supports 318. The ribs 316 are spaced apart and the supports 318 extend through the coupling holes 326 in the ribs 316. The top grapple arm 202 is pivotally attached via a top shaft 314 and connectors 327 to the top plate 300 (FIG. 3). The top shaft 314 extends through the rotatable coupling holes 324. Bearings, lubrication, or other methods known in the art facilitate rotatable coupling. The top grapple arm 202 is pivotable about an axis formed by the shaft 314 between a top grapple arm receive position (e.g. FIG. 1) and a top grapple arm feed position (e.g. FIG. 4). Rotation of the top grapple arm 202 is bounded in the top grapple arm feed position by an abutment between an edge 328 of the ribs 316 and the top plate 300.

The top grapple arm 202 can be configured so that when in the top grapple arm feed position, the side grapple arms 204, 206 are movable between the side arm receive position and the side arm feed position. In other words, the top grapple arm 202 does not cross the path or restrict the movement of the side grapple arms 204, 206 at any position (e.g. FIGS. 9 and 11). In some examples, the top grapple arm 202 can include top connectors 320 which are configured to receive mechanical power for moving the top grapple arm between the top arm receive position and the top arm feed position.

The grinder unit 100 includes the bottom member 208 which can be used to wedge beneath debris and can provide a surface for debris to be moved upwards and into the feed opening 210. The bottom member 208 is adjacent to the bottom portion of the feed opening 210. The bottom member 208 may include a plurality of ribs 408, 409 (e.g. FIG. 4) and supports 412, 413. The ribs 408, 409 (i.e. vertically-oriented plates) are vertically oriented and spaced horizontally.

It is beneficial for the grinder heads 400, 402 to be raised from the ground-level surface so that comminuted debris can be discharged by gravity from the grinder unit 100. For example, the ribs 408, 409 are generally tapered from a narrow configuration at the front to a wider configuration at the rear (relative to the grinder unit 100), or in other words, the ribs 408, 409 are formed in wedge or ramp shapes to raise debris upward from the ground surface towards the feed opening 210. The bottom member 208 provides a ramp which can be used to raise debris upwards or can be used as a raised surface for placing debris.

The support 412 extends through openings located near the front of the ribs 408, 409 and provides structural rigidity to the bottom member 208 by anchoring the ribs 408, 409. The bottom member 208 can be wider than the feed opening 210 so that a portion of the bottom member 208 extends beyond the feed opening 210 on either side of the grinder unit 100. In the illustrated example, the ribs 408 positioned on either side of the feed opening 210 are attached to the front plates 307 (FIG. 8), while ribs 409 extend into the feed opening 210 and are supported by support 413. Support 413 extends through openings located in the ribs 409. Two of the ribs 409 can extend into the feed opening 210 and are attached to the sidewalls 306. The ribs 409 can have a rear portion with a groove 414 to accommodate the bottom grinder head 402 (FIG. 9) and can be attached at the rear to the bottom plate 302. In that way, the rear portions span the discharge opening 310.

Additional partial ribs 415 can be positioned between the ribs 408 that extend into the feed opening 210. The partial ribs 415 are supported by support 413 which extends through openings located near the front of the partial ribs 415. The partial ribs 415 can include a groove to accommodate the bottom grinder head 402. The partial ribs 415 can be similarly attached at the rear to the bottom plate 302 and can span the discharge opening 310.

The grinder heads 400, 402 rotate within the grinder unit 100 and rend the debris into smaller pieces as it passes through the feed opening 210. The grinder heads 400, 402 are rotatably mounted to the frame 200 adjacent to the feed opening 210 by mounting shafts 312 which pass through the sidewalls 306 (FIG. 3). The grinder heads 400, 402 are thus rotatable about axes that are concentric with the shafts 312. Bearings or other known friction-reducing devices can be included to reduce frictional energy losses during rotation of the grinder heads 400, 402. In some examples, the bearings can be incorporated into the sidewalls 306 so that the shafts 312 are rotatable relative to the sidewalls 306.

At least one end of each shaft 312 can be configured to receive rotational mechanical energy. In some examples, mechanical coupling devices such as belts, chains, and gears (not shown) connect a power source to the shafts 312. In some examples, the grinder heads 400, 402 may each be connected to separate and independent power sources. The grinder heads 400, 402 may be capable of rotating synchronously or independently. During one mode of operation, the grinder heads 400, 402 rotate in the same direction and at the same rotational rates. Alternatively, the grinder heads 400, 402 can rotate in opposite directions and/or at different rotational rates, as well as any combination or configuration of the above. In some examples, independent relative rotation rates are achieved with variable speed belt drives or manually changeable pulleys.

Figure 9:
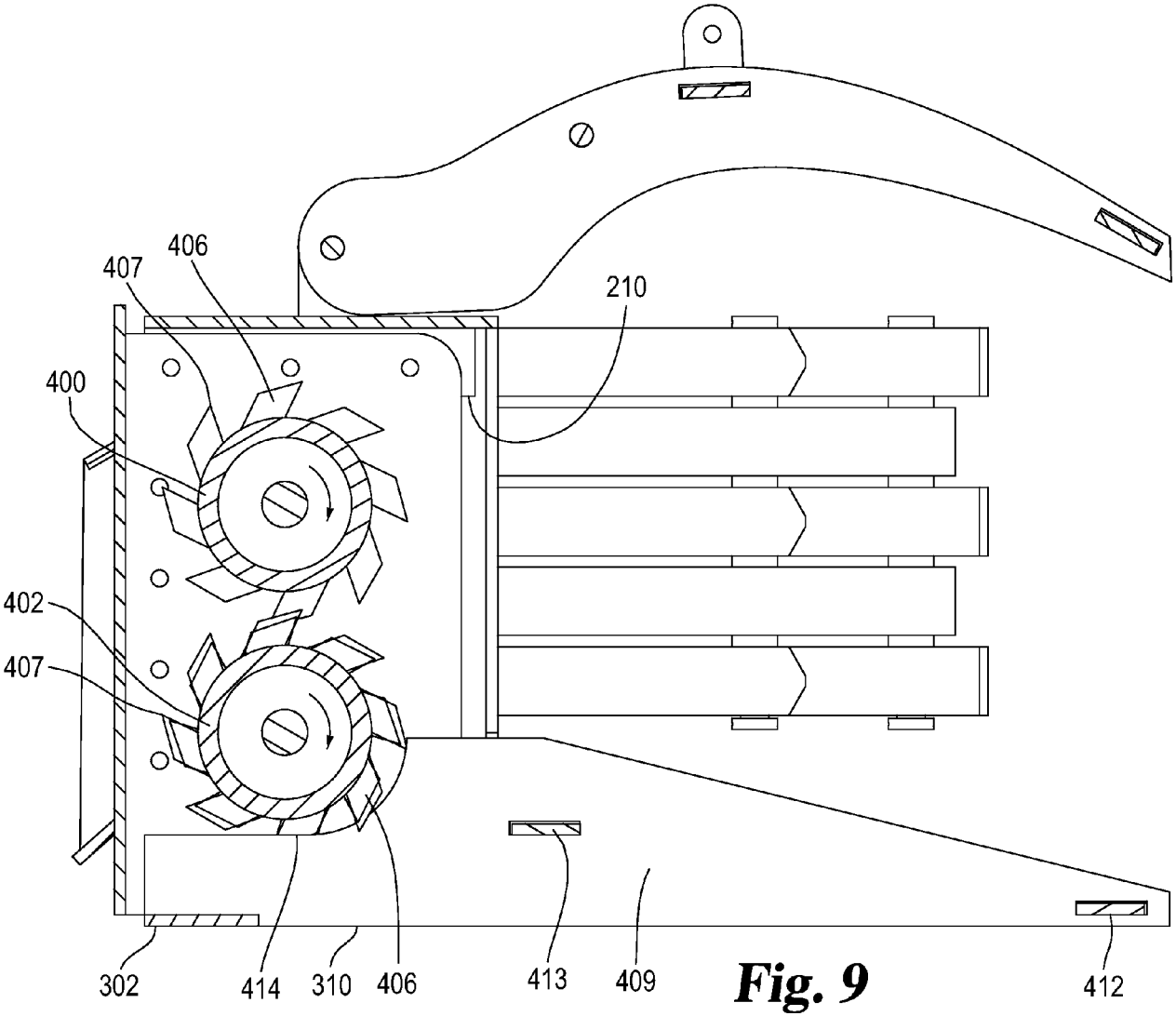
FIG. 9 is a side cross-sectional view of the grinder unit of FIG. 1.
Figure 10:
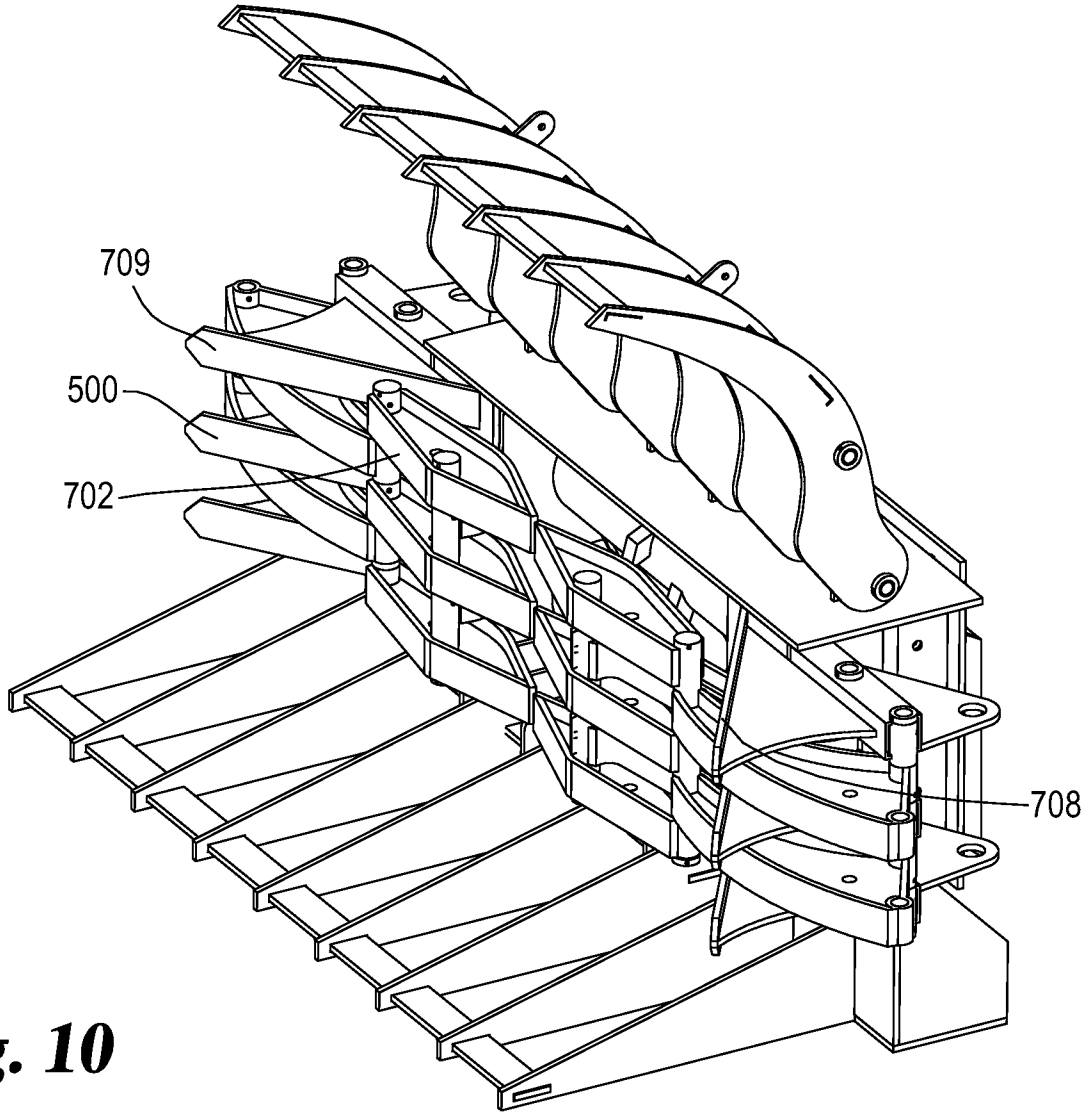
FIG. 10 is a front perspective view of the grinder unit of FIG. 1 having side grapple arms positioned in the feed position and the top grapple arm positioned in the top arm receive position.

Referring generally to FIG. 9 (showing a cross-section of the grinder unit 100 and likewise the grinder heads 400, 402), the grinder heads 400, 402 include teeth 406 (or cutters) positioned on the outer surfaces of the grinder heads 400, 402 (FIG. 9). In some examples, the teeth 406 are separate parts that are welded to the outer surface of the grinder heads 400, 402. In other examples, the teeth 406 are formed as part of the grinder heads 400, 402. The teeth 406 can be positioned about the outer surfaces of the grinder heads 400, 402 so that they are spaced from one another in both the axial direction as well as radially, or in the circumferential direction relative to the grinder heads. In other words, the teeth 406 can be configured in a pattern of discrete bands extending circumferentially about the surface of the grinder heads 400, 402. Within the bands, the teeth 406 can be positioned intermittently. The discrete bands are separated from one another in the axial direction by a distance that is at least as wide as the teeth 406 to allow passage therebetween of the teeth 406 from the counterpart grinder head. In that way, the teeth 406 of the top grinder head 400 are aligned with circumferential spaces (or gaps) between the teeth 406 of the bottom grinder head 402 (FIG. 5), and the teeth 406 of the bottom grinder head 402 are aligned with circumferential spaces between the teeth 406 of the top grinder head 400.

The teeth 406 can be positioned on the grinder heads 400, 402 in an orientation that is angularly offset relative to the center axis of rotation (e.g. FIG. 9). Each of the teeth 406 may include a cutting edge 407 positioned on the leading side of the teeth 406 relative to the direction of rotation. In one example, the grinder heads 400, 402 are configured to both rotate in a clockwise direction (relative to the configuration of FIG. 9). In the illustrated example, two teeth 406 are spaced equidistant from one another within the circumferential bands and axially offset from neighboring circumferential bands. Each circumferential band can include more or fewer than two teeth 406. The teeth 406 of the bottom grinder head 402 can be positioned to have some overlap in the vertical direction with the teeth 406 of the top grinder head 400 when the teeth 406 are proximate (e.g. FIGS. 5 and 9). In that way, the teeth 406 of the top grinder head 400 and the bottom grinder head 402 rotate in an interleaved configuration.

The spacing between the teeth 406 between the grinder heads 400, 402 determines the size of debris (and therefore the density) that can be produced. In various examples, the teeth 406 can have varied sizes. For example, particular circumferential bands of teeth 406 can have widths or heights that are different from other circumferential bands. In some examples, the teeth 406 can have widths or heights that are varied even within a single circumferential band. In other examples, the teeth 406 can be spaced in non-equidistant configurations and/or include different numbers of teeth 406. In some examples, the teeth 406 can be sized and spaced randomly within the circumferential bands. In some examples, the grinder heads 400, 402 can be sized differently (e.g. having different diameters).

The interleaved configuration (or staggered arrangement) and the angular offset positioning of the teeth 406 of the grinder heads 400, 402 are advantageous for rending debris. The grinder heads 400, 402 impact debris as it passes through the feed opening 210. Because the teeth 406 move in opposing directions at the location where the teeth 406 of the two grinder heads 400, 402 are proximate, the forces applied to the debris by the teeth 406 at this location are opposite. This results in a generally neutral laterally-directed pull force on the debris. The opposing interaction of the teeth 406 of the top grinder head 400 with the teeth 406 of the bottom grinder head 402 causes a shearing force which cuts, shreds, and/or otherwise rends the debris. The cutting edges 407 enhance the rending. The neutral pull force on the debris tends to allow the debris to stay in the proximity of the grinder heads 400, 402 where it is continually rended into smaller and smaller pieces. The grinder heads 400, 402 and the teeth 406 can be configured to provide spaces therebetween for smaller pieces of rended debris to pass through and ultimately through the discharge opening 310. The downward pull force from the forward portion of the bottom grinder head 402 tends to move smaller pieces of rended debris toward the discharge opening 310. Similarly, the rotational motion of the top grinder head 400 tends to move smaller pieces of rended debris toward the debris shield 308. The debris shield 308 deflects the rended debris and subsequently the rended debris falls downward through the discharge opening 310.

The configuration of grinder heads 400, 402 avoids problems with single head grinders as well as dual head grinders that rotate in opposing directions. Single head grinders and dual head grinders rotating in opposite directions tend to pull debris into the cutting area which can choke the cutting area and slow the rending process while simultaneously providing little control over the feed rate into the grinder heads. By rotating the grinder heads 400, 402 in the same direction, a neutral pull effect on the debris is achieved and the feed rate can be controlled by the side grapple arms 202, 204 as they are advanced toward the grinder heads 400, 402. In various examples, the relative speed of each grinder head can be varied to compensate for differences in the debris being processed.

The grinder unit 100 can be configured to apply controlled mechanical power at multiple locations. The mounting shafts 312 of the grinder heads 400, 402 can each be configured to receive independent rotational mechanical power to make the grinder heads 400, 402 rotate about the axes of the mounting shafts 312. The side grapple arms 204, 206 can each be configured to receive independent translational and rotational mechanical power at the driver pivot joints 802 in order to rotate the side grapple arms 204, 206 between the receive position and the feed position. The top grapple arm 202 can be configured to receive mechanical power at the top connectors 320 in order to pivot the top grapple arm 202 between the top arm receive position and the top arm feed position.

Mechanical power can be supplied by a variety of sources which are known in the art. In one example mechanical power can be supplied hydraulically or by a diesel engine. In other examples, the grinder unit 100 can be be attached to a vehicle which is capable of carrying the extra weight of a dedicated power source (such as a diesel powered engine). In other examples, the grinder unit 100 can be attached to a vehicle (such as the skid-steer loader 102) which is capable of powering the grinder unit 100 with its own power source, such as a hydraulic power system. In still other examples the grinder unit 100 can be configured as an independent unit having its own power source that is capable of being transported to a debris site and operated independent of any vehicle. When mounted to the skid-steer loader 102, the grinder unit 100 utilizes the hydraulic power of the skid-steer loader 102. In that case, hydraulic actuators (not shown) are powered by the hydraulic system of the skid-steer loader 102 in order to drive the side grapple arms 204, 206, the top grapple arm 202, and the grinder heads 400, 402.

An operational example of the grinder unit 100 will now be described in the context of the grinder unit 100 mounted to the skid-steer loader 102. The grinder unit 100 is moved about a debris site by the skid-steer loader 102. If mounted to the lift arms 104, the grinder unit 100 may be raised above ground level in order to be transported to an area where it is desirable for debris to be rended and shredded into smaller pieces. The grinder unit 100 is raised or lowered to a target level (i.e. a desired level) and the grinder heads 400, 402 are powered to rotate. In the initial stage, to begin receiving debris, the side grapple arms 204, 206 are positioned in the receive position and the top grapple arm 202 is positioned in the top arm receive position (FIG. 1).

The skid-steer loader 102 can then load debris onto the grinder unit 100 by wedging the bottom member 208 beneath the debris and moving forward to move debris onto the bottom member 208. The bottom member has an inclined surface which guides debris upwards and towards or into the feed opening 210. Alternatively, debris is pushed or moved on to the bottom member 208. In some instances the debris to be comminuted may have a height which is too large to fit within the grinding cavity 404 via the feed opening 210. In that case, the top grapple arm 202 can be engaged. The top grapple arm 202 is powered to rotate and move from the top arm receive position towards the top arm feed position. When moving from the top arm receive position to the top arm feed position, the top grapple arm 202 can engage debris and smash or otherwise bias it downwards towards the bottom member 208, thereby reducing the height of the debris. The top grapple arm 202 can be moved as desired up to its fully closed feed position (e.g. FIG. 2).

Figure 11:
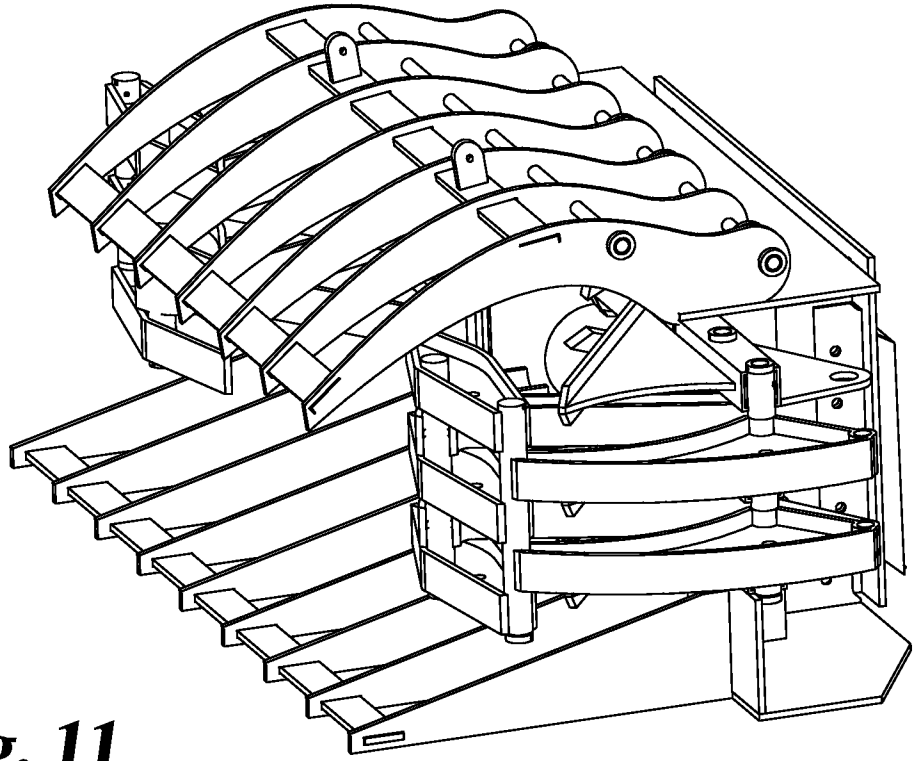
FIG. 11 is a front perspective view of the grinder unit of FIG. 1 having the top grapple arm positioned in the top arm feed position and side grapple arms positioned between the receive position and the feed position.

After the top grapple arm 202 is positioned as desired, the side grapple arms 204, 206 can be engaged and moved from the receive position towards the feed position in order to move debris further towards the grinder heads 400, 402, as shown in FIG. 11. When the side grapple arms 204, 206 are fully in the feed position, the couplers 702 substantially span the feed opening so that substantially all of the debris is moved into the feed opening 210.

Generally, the grinder heads 400, 402 can interact with the debris and rend the debris into smaller pieces. As debris is being rended (or processed) by the grinder heads 400, 402, the debris includes pieces of various sizes. The grinder heads 400, 402 are designed to continue the rending process on larger pieces of debris while rended pieces of debris that are sufficiently small pass through the grinder unit 100 and are expelled through the discharge opening 310. In that way, at any moment during the grinding process, the grinder unit can generally include debris at various states of comminution, and the term "debris" as used herein refers to the same.

The grinding process can continue until the debris is substantially shredded and expelled through the discharge opening 310. At that time, if the top grapple arm 202 is in a closed or partially closed position, it can be moved to the top arm receiving position. Similarly, the side grapple arms 204, 206 can be moved out of the feed position to the receive position (FIG. 1) and the grinding process can continue by introducing more debris to the grinder unit 100 which can include loading debris onto the bottom member 208 or moving the grinder unit 100. In some circumstances, the grinder unit 100 can be moved to a new location while debris is being shredded. The expelled comminuted debris remains behind, where it is ready to be loaded into a truck for removal or other suitable processing.

The grinder unit 100 can be constructed in a partial skeleton fashion including the ribs 408, 409 of the bottom member 208 as well as the ribs 316 of the top grapple arm 202. This reduces the weight of the grinder unit 100 while maintaining sufficient structural rigidity to perform necessary functions. Similarly, parts of the side grapple arms 204, 206 can be constructed as modified I-beams which further reduce the weight while maintaining strength and structural rigidity. The reduced weight allows the grinder unit 100 to be mounted to a wide variety of support vehicles, facilitating ease of transport about a debris field. As an added function, the spaced configuration of the ribs 408, 409 of the bottom member 208 allows smaller pieces of debris and/or shredded debris to fall downward and pass between the ribs 408, 409, thereby ensuring that larger pieces of debris pass through the feed opening 210.

Although specific mention of materials was not included for all parts of the grinder unit 100, various suitable materials can be used. In one example, the grinder unit 100 and all parts thereof can be constructed of a suitable material such as steel. In other examples, the grinder unit 100 can be constructed of other materials which are sufficiently rigid and strong. In some examples, various parts of the grinder unit 100 can each be constructed of different suitable materials.

While the disclosure has been illustrated and described in detail in the drawings and foregoing description, the same is to be considered as illustrative and not restrictive in character, it being understood that only the preferred example has been shown and described and that all changes, equivalents, and modifications that come within the spirit of the disclosures defined by following claims are desired to be protected.

The invention claimed is:

1. A device, comprising:

a grinder unit having a frame defining a vertical facing feed opening for receiving debris to be comminuted, said opening having a top edge and two lateral sides;

a top grapple arm pivotally mounted to the frame adjacent to the top edge of the feed opening;

at least one side grapple arm moveably mounted to the frame adjacent to a side of the feed opening, wherein the side grapple arm is pivotable between a receive position and a feed position and wherein the side grapple arm can advance debris toward the feed opening when moving from the receive position to the feed position; and wherein the pivot axes of the top grapple arm and the side grapple arm are non-parallel.

2. The device of claim 1, further comprising a pair of side grapple arms pivotally mounted to the frame adjacent to opposite sides of the feed opening, wherein the side grapple arms are each pivotable between a receive position and a feed position and wherein the side grapple arms can advance debris towards the feed opening when moving from the receive position to the feed position.

3. The device of claim 2, wherein the pair of side grapple arms are pivotable relative to each other.

4. The device of claim 2, wherein each side grapple arm has a coupler for pushing debris and wherein when in the feed position, the couplers are aligned with and adjacent to the feed opening.

5. The device of claim 4, wherein each side grapple arm includes a four-bar mechanism having a rocker, and wherein when moving between the receive position and the feed position, the coupler rotates less than the rocker relative to the grinder unit.

6. The device of claim 5, wherein each four-bar mechanism includes a plurality of couplers and a plurality of rockers, and wherein the rockers are interleaved with the couplers.

7. The device of claim 1, further comprising a bottom member mounted to the frame opposite from the top grapple arm and adjacent to the feed opening, wherein the bottom member defines a path for debris to be advanced toward the feed opening, and wherein the path raises the debris.

8. The device of claim 1, further comprising a discharge opening defined by the frame and positioned below the grinder unit for passage of comminuted debris.

9. The device of claim 1, further comprising a pair of rotatable grinder heads positioned adjacent to the feed opening to receive and comminute debris through the feed opening, wherein the grinder heads are rotatable about parallel axes, and wherein the grinder heads include a plurality of cutters positioned on the outer surfaces of the grinder heads.

10. The device of claim 8, wherein the grinder heads are configured to rotate about parallel axes in the same rotational direction.

11. The device of claim 1, wherein the grinder unit is attached to a skid-steer loader including a hydraulic system for providing mechanical power to the side grapple arm and top grapple arm.

12. A device comprising:

a grinder unit having a frame defining a feed opening for receiving debris to be comminuted;

a top grapple arm pivotally mounted to the frame adjacent to the feed opening;

a bottom member mounted to the frame opposite from the top grapple arm and adjacent to the feed opening;

a pair of side grapple arms moveably mounted to the frame adjacent to opposite sides of the feed opening, wherein the side grapple arms are each moveable between a receive position and a feed position, and wherein movement of the side grapple arms from the receive position to the feed position advances debris toward the feed opening; and a hydraulic system attached to the side grapple arms, wherein the hydraulic system provides mechanical power for moving the side grapple arms between the receive position and the feed position.

13. The device of claim 12, wherein the pair of side grapple arms are movable within a height between the top grapple arm and the bottom member.

14. The device of claim 12, wherein each side grapple arm includes a four-bar mechanism having a coupler for pushing debris and a crank, wherein when in the feed position, the couplers are substantially aligned with and adjacent to the feed opening, and wherein when moving between the receive position and the feed position, the coupler rotates less than the crank relative to the grinder unit.

15. The device of claim 12, wherein the bottom member extends forward from the frame, and wherein the bottom member has an inclined surface for moving debris vertically towards the feed opening.

16. The device of claim 12, further comprising a pair of rotatable grinder heads positioned adjacent to the feed opening to receive and comminute debris through the feed opening.

17. The device of claim 12, wherein the grinder heads include a plurality of cutters positioned on the outer surfaces of the grinder heads, and wherein the cutters are interleaved between the grinder heads.

18. The device of claim 12, wherein the hydraulic system is part of a skid-steer loader.

19. The device of claim 12, wherein the top grapple arm rotates about an axis that is nonparallel to the axes of the side grapple arms.

* * * * *